US009882288B2

(12) United States Patent
Black et al.

(10) Patent No.: US 9,882,288 B2
(45) Date of Patent: Jan. 30, 2018

(54) SLOTTED SURFACE SCATTERING ANTENNAS

(71) Applicant: Searete LLC, Bellevue, WA (US)

(72) Inventors: Eric J. Black, Bothell, WA (US); Brian Mark Deutsch, Snoqualmie, WA (US); Alexander Remley Katko, Bellevue, WA (US); Melroy Machado, Bellevue, WA (US); Jay Howard McCandless, Alpine, CA (US); Yaroslav A. Urzhumov, Bellevue, WA (US)

(73) Assignee: The Invention Science Fund I LLC

( * ) Notice: Subject to any disclaimer, the term of this patent is extended or adjusted under 35 U.S.C. 154(b) by 0 days.

(21) Appl. No.: 14/755,579

(22) Filed: Jun. 30, 2015

(65) Prior Publication Data

US 2015/0380828 A1 Dec. 31, 2015

Related U.S. Application Data

(63) Continuation-in-part of application No. 14/506,432, filed on Oct. 3, 2014.

(Continued)

(51) Int. Cl.

| | |
|---|---|
| ***H01Q 9/00*** | (2006.01) |
| ***H01Q 23/00*** | (2006.01) |
| ***H01H 59/00*** | (2006.01) |
| ***H01Q 3/44*** | (2006.01) |
| ***H01Q 13/20*** | (2006.01) |
| *H01Q 9/04* | (2006.01) |

(52) U.S. Cl.

CPC ..... *H01Q 23/00* (2013.01); *H01H 59/0009* (2013.01); *H01Q 3/443* (2013.01); *H01Q 13/206* (2013.01); *H01Q 9/0407* (2013.01)

(58) Field of Classification Search

CPC ..... H01Q 3/443; H01Q 13/206; H01Q 23/00

See application file for complete search history.

(56) References Cited

U.S. PATENT DOCUMENTS 3,001,193 A 9/1961 Marie
3,044,066 A * 7/1962 Butler ..... H01Q 13/26 343/771

(Continued)

FOREIGN PATENT DOCUMENTS

FR 2958805 A1 * 10/2011 ..... H01Q 1/38
JP 2007-081825 A 3/2007

(Continued)

OTHER PUBLICATIONS

IP Australia Patent Examination Report No. 1; Patent Application No. 2011314378; dated Mar. 4, 2016; pp. 1-4.

(Continued)

*Primary Examiner* — Dieu H Duong

(57) ABSTRACT

Surface scattering antennas with lumped elements provide adjustable radiation fields by adjustably coupling scattering elements along a waveguide. In some approaches, the scattering elements include slots in an upper surface of the waveguide, and the lumped elements are configured to span the slots provide adjustable loading. In some approaches, the scattering elements are adjusted by adjusting bias voltages for the lumped elements. In some approaches, the lumped elements include diodes or transistors.

45 Claims, 6 Drawing Sheets

Related U.S. Application Data

(60) Provisional application No. 61/988,023, filed on May 2, 2014.

(56) References Cited

U.S. PATENT DOCUMENTS 3,388,396 A 6/1968 Rope et al.
3,604,012 A 9/1971 Lindley
3,714,608 A 1/1973 Barnes et al.
3,757,332 A 9/1973 Tricoles
3,887,923 A 6/1975 Hendrix
4,195,262 A 3/1980 King
4,229,745 A 10/1980 Kruger
4,291,312 A 9/1981 Kaloi
4,305,153 A 12/1981 King
4,489,325 A 12/1984 Bauck et al.
4,509,209 A 4/1985 Itoh et al.
4,672,378 A 6/1987 Drabowitch et al.
4,701,762 A 10/1987 Apostolos
4,780,724 A 10/1988 Sharma et al.
4,832,429 A 5/1989 Nagler
4,874,461 A 10/1989 Sato et al.
4,920,350 A 4/1990 McGuire et al.
4,947,176 A 8/1990 Inatsune et al.
4,978,934 A 12/1990 Saad
5,198,827 A 3/1993 Seaton
5,455,590 A 10/1995 Collins et al.
5,512,906 A 4/1996 Speciale
5,734,347 A 3/1998 McEligot
5,841,543 A 11/1998 Guldi et al.
5,889,599 A 3/1999 Takemori
5,943,016 A * 8/1999 Snyder, Jr. ..... H01Q 1/38 343/700 MS
6,031,506 A 2/2000 Cooley et al.
6,061,023 A 5/2000 Daniel et al.
6,061,025 A 5/2000 Jackson et al.
6,075,483 A 6/2000 Gross
6,084,540 A 7/2000 Yu
6,114,834 A 9/2000 Parise
6,166,690 A 12/2000 Lin et al.
6,198,453 B1 3/2001 Chew
6,211,823 B1 4/2001 Herring
6,232,931 B1 5/2001 Hart
6,236,375 B1 5/2001 Chandler et al.
6,275,181 B1 8/2001 Kitayoshi
6,366,254 B1 4/2002 Sievenpiper et al.
6,384,797 B1 5/2002 Schaffner et al.
6,396,440 B1 5/2002 Chen
6,469,672 B1 10/2002 Marti-Canales et al.
6,545,645 B1 4/2003 Wu
6,552,696 B1 4/2003 Sievenpiper et al.
6,633,026 B2 10/2003 Tuominen
6,985,107 B2 1/2006 Anson et al.
7,068,234 B2 6/2006 Sievenpiper
7,151,499 B2 12/2006 Avakian et al.
7,154,451 B1 12/2006 Sievenpiper
7,176,842 B2 * 2/2007 Bettner ..... H01Q 9/14 343/702
7,253,780 B2 8/2007 Sievenpiper
7,295,146 B2 11/2007 McMakin et al.
7,307,596 B1 12/2007 West
7,339,521 B2 3/2008 Scheidemann et al.
7,428,230 B2 9/2008 Park
7,456,787 B2 11/2008 Manasson et al.
7,609,223 B2 10/2009 Manasson et al.
7,667,660 B2 2/2010 Manasson et al.
7,830,310 B1 11/2010 Sievenpiper et al.
7,834,795 B1 11/2010 Dudgeon et al.
7,864,112 B2 1/2011 Manasson et al.
7,911,407 B1 3/2011 Fong et al.
7,929,147 B1 4/2011 Fong et al.
7,995,000 B2 8/2011 Manasson et al.
8,009,116 B2 8/2011 Peichl et al.
8,014,050 B2 9/2011 McGrew
8,040,586 B2 10/2011 Smith et al.
8,059,051 B2 11/2011 Manasson et al.
8,134,521 B2 3/2012 Herz et al.
8,179,331 B1 5/2012 Sievenpiper
8,212,739 B2 7/2012 Sievenpiper
8,339,320 B2 12/2012 Sievenpiper
8,456,360 B2 6/2013 Manasson et al.
9,231,303 B2 1/2016 Edelmann et al.
9,268,016 B2 2/2016 Smith et al.
9,389,305 B2 7/2016 Boufounos
9,634,736 B2 4/2017 Mukherjee et al.
2002/0039083 A1 4/2002 Taylor et al.
2002/0167456 A1 11/2002 McKinzie, III
2003/0214443 A1 11/2003 Bauregger et al.
2004/0227668 A1 11/2004 Sievenpiper
2004/0263408 A1 12/2004 Sievenpiper et al.
2005/0031295 A1 2/2005 Engheta et al.
2005/0057399 A1 * 3/2005 Kipnis ..... H01Q 1/38 343/700 MS
2005/0088338 A1 4/2005 Masenten et al.
2006/0065856 A1 3/2006 Diaz et al.
2006/0114170 A1 6/2006 Sievenpiper
2006/0116097 A1 6/2006 Thompson
2006/0132369 A1 6/2006 Robertson et al.
2006/0187126 A1 8/2006 Sievenpiper
2007/0085757 A1 4/2007 Sievenpiper
2007/0103381 A1 5/2007 Upton
2007/0159395 A1 7/2007 Sievenpiper et al.
2007/0159396 A1 7/2007 Sievenpiper et al.
2007/0182639 A1 8/2007 Sievenpiper et al.
2007/0200781 A1 8/2007 Ahn et al.
2007/0229357 A1 10/2007 Zhang et al.
2008/0020231 A1 1/2008 Yamada et al.
2008/0165079 A1 7/2008 Smith et al.
2008/0180339 A1 7/2008 Yagi
2008/0224707 A1 9/2008 Wisler et al.
2008/0259826 A1 10/2008 Struhsaker
2008/0268790 A1 10/2008 Shi et al.
2008/0316088 A1 12/2008 Pavlov et al.
2009/0002240 A1 1/2009 Sievenpiper et al.
2009/0045772 A1 2/2009 Cook et al.
2009/0109121 A1 4/2009 Herz et al.
2009/0147653 A1 6/2009 Waldman et al.
2009/0195361 A1 8/2009 Smith
2009/0251385 A1 10/2009 Xu et al.
2010/0066629 A1 3/2010 Sievenpiper
2010/0073261 A1 3/2010 Sievenpiper
2010/0079010 A1 4/2010 Hyde et al.
2010/0109972 A2 5/2010 Xu et al.
2010/0134370 A1 6/2010 Oh et al.
2010/0156573 A1 6/2010 Smith et al.
2010/0157929 A1 6/2010 Karabinis
2010/0188171 A1 7/2010 Mohajer-Iravani et al.
2010/0279751 A1 11/2010 Pourseyed et al.
2010/0328142 A1 12/2010 Zoughi et al.
2011/0098033 A1 4/2011 Britz et al.
2011/0117836 A1 5/2011 Zhang et al.
2011/0128714 A1 6/2011 Terao et al.
2011/0151789 A1 6/2011 Viglione et al.
2011/0267664 A1 11/2011 Kitamura et al.
2012/0026068 A1 2/2012 Sievenpiper
2012/0038317 A1 2/2012 Miyamoto et al.
2012/0112543 A1 5/2012 van Wageningen et al.
2012/0194399 A1 8/2012 Bily et al.
2012/0219249 A1 8/2012 Pitwon
2012/0268340 A1 10/2012 Capozzoli et al.
2012/0274147 A1 11/2012 Stecher et al.
2012/0280770 A1 * 11/2012 Abhari ..... H01P 1/184 333/209
2012/0326660 A1 12/2012 Lu et al.
2013/0069865 A1 3/2013 Hart
2013/0082890 A1 4/2013 Wang et al.
2013/0237272 A1 9/2013 Prasad
2013/0249310 A1 9/2013 Hyde et al.
2013/0278211 A1 10/2013 Cook et al.
2013/0288617 A1 10/2013 Kim et al.
2013/0343208 A1 12/2013 Sexton et al.
2014/0128006 A1 5/2014 Hu

(56) References Cited

U.S. PATENT DOCUMENTS

| | | | |
|---|---|---|---|
| 2014/0266946 | A1 | 9/2014 | Bily et al. |
| 2015/0280444 | A1 | 10/2015 | Smith et al. |
| 2017/0098961 | A1 | 4/2017 | Harpham |

FOREIGN PATENT DOCUMENTS

| | | | | |
|---|---|---|---|---|
| JP | 2008-054146 | A | | 3/2008 |
| JP | 2010-187141 | A | | 8/2010 |
| JP | 2012156871 | A | * | 8/2012 |
| KR | 10-1045585 | B1 | | 6/2011 |
| WO | WO 01/73891 | A1 | | 10/2001 |
| WO | WO 2008-007545 | A1 | | 1/2008 |
| WO | WO 2008/059292 | A2 | | 5/2008 |
| WO | WO 2009/103042 | A2 | | 8/2009 |
| WO | WO 2010/0021736 | | | 2/2010 |
| WO | PCT/US2013/212504 | | | 5/2013 |
| WO | WO 2013/147470 | A1 | | 10/2013 |

OTHER PUBLICATIONS

PCT International Search Report; International App. No. PCT/US2016/037667; dated Sep. 7, 2016; pp. 1-3.

Canadian Intellectual Property Office, Canadian Examination Search Report, Pursuant to Subsection 30(2); App. No. 2,814,635; dated Dec. 1, 2016 (received by our Agent on Dec. 6, 2016); pp. 1-3.

European Search Report; European App. No. EP 11 832 873.1; dated Sep. 21, 2016; pp. 1-6.

The State Intellectual Property Office of P.R.C., Fifth Office Action, App. No. 2011/80055705.8 (Based on PCT Patent Application No. PCT/US2011/001755); dated Nov. 16, 2016 (received by our Agent on Nov. 23, 2016); pp. 1-3 (machine translation, as provided).

PCT International Search Report; International App. No. PCT/US2015/028781; dated Jul. 27, 2015; pp. 1-3.

Patent Office of the Russian Federation (Rospatent) Office Action; Application No. 2013119332/28(028599); dated Oct. 13, 2015 (received by our agent on Oct. 23, 2015); machine translation; pp. 1-5.

Extended European Search Report; European App. No. EP 14 77 0686; dated Oct. 14, 2016 (recieved by our agent on Oct. 12, 2016); pp. 1-7.

Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.

Amineh et al.; "Three-Dimensional Near-Field Microwave Holography for Tissue Imaging"; International Journal of Biomedical Imaging; Bearing a date of Dec. 21, 2011; pp. 1-11; vol. 2012, Article ID 291494: Hindawi Publishing Corporation.

"Array Antenna with Controlled Radiation Pattern Envelope Manufacture Method"; ESA; Jan. 8, 2013; pp. 1-2; http://www.esa.int/Our_Activities/Technology/Array_antenna_with_controlled_radiation_pattern_envelope_manufacture_method.

Belloni, Fabio; "Channel Sounding"; S-72.4210 PG Course in Radio Communications; Bearing a date of Feb. 7, 2006; pp. 1-25.

Chen, Robert; *Liquid Crystal Displays*, Wiley, New Jersey 2011 (not provided).

Chin, J.Y. et al.; "An efficient broadband metamaterial wave retarder"; Optics Express; vol. 17, No. 9; p. 7640-7647; 2009.

Chu, R. S. et al.; "Analytical Model of a Multilayered Meaner-Line Polarizer Plate with Normal and Oblique Plane-Wave Incidence"; IEEE Trans. Ant. Prop.; vol. AP-35, No. 6; p. 652-661; Jun. 1987.

Colburn et al.; "Adaptive Artificial Impedance Surface Conformal Antennas"; in Proc. IEEE Antennas and Propagation Society Int. Symp.; 2009; p. 1-4.

Courreges et al.; "Electronically Tunable Ferroelectric Devices for Microwave Applications"; *Microwave and Millimeter Wave Technologies from Photonic Bandgap Devices to Antenna and Applications*; ISBN 978-953-7619-66-4; Mar. 2010; p. 185-204; InTech.

Cristaldi et al., Chapter 3 "Passive LCDs and Their Addressing Techniques" and Chapter 4 "Drivers for Passive-Matrix LCDs"; *Liquid Crystal Display Drivers: Techniques and Circuits*; ISBN 9048122546; Apr. 8, 2009; p. 75-143; Springer.

Den Boer, Wilem; *Active Matrix Liquid Crystal Displays*; Elsevier, Burlington, MA, 2009 (not provided).

Diaz, Rudy; "Fundamentals of EM Waves"; Bearing a date of Apr. 4, 2013; 6 total pages, located at: http://www.microwaves101.com/encycolpedia/absorbingradar1.cfm.

Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.

Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.

European Patent Office, Supplementary European Search Report, pursuant to Rule 62 EPC; App. No. EP 11 83 2873; May 15, 2014 (received by our Agent on May 21, 2014); 7 pages.

Evlyukhin, Andrey B. and Bozhevolnyi, Sergey I.; "Holographic evanescent-wave focusing with nanoparticle arrays"; Optics Express; Oct. 27, 2008; p. 17429-17440; vol. 16, No. 22; OSA.

Fan, Yun-Hsing et al.; "Fast-response and scattering-free polymer network liquid crystals for infrared light modulators"; Applied Physics Letters; Feb. 23, 2004; p. 1233-1235; vol. 84, No. 8; American Institute of Physics.

Fong, Bryan H. et al.; "Scalar and Tensor Holographic Artificial Impedance Surfaces" IEEE Transactions on Antennas and Propagation; Oct. 2010; p. 3212-3221; vol. 58, No. 10; IEEE.

Frenzel, Lou; "What's the Difference Between EM Near Field and Far Field?"; Electronic Design; Bearing a date of Jun. 8, 2012; 7 total pages; located at: http://electronicdesign.com/energy/what-s-difference-between-em-field-and-far-field.

Grbic, Anthony; "Electrical Engineering and Computer Science"; University of Michigan; Create on Mar. 18, 2014, printed on Jan. 27, 2014; pp. 1-2; located at http;//sitemaker.umich.edu/agrbic/projects.

Grbic et al.; "Metamaterial Surfaces for Near and Far-Field Applications"; 7$^{th}$ European Conference on Antennas and Propagation (EUCAP 2013); Bearing a date of 2013, Created on Mar. 18, 2014; pp. 1-5.

Hand, Thomas H. et al.; "Characterization of complementary electric field coupled resonant surfaces"; Applied Physics Letters; published on Nov. 26, 2008; pp. 212504-1-212504-3; vol. 93; Issue 21; American Institute of Physics.

Imani et al.; "A Concentrically Corrugated Near-Field Plate"; Bearing a date of 2010; Created on Mar. 18, 2014; pp. 1-4; IEEE.

Imani et al.; "Design of a Planar Near-Field Plate"; Bearing at date of 2012, Created on Mar. 18, 2014; pp. 102, IEEE.

Imani et al.; "Planar Near-Field Plates"; Bearing a date of 2013, Create on Mar. 18, 2014; pp. 1-10; IEEE.

Intellectual Property Office of Singapore Examination Report; Application No. 2013027842; Feb. 27, 2015; (received by our Agent on Apr. 28, 2015); pp. 1-12.

Islam et al.; "A Wireless Channel Sounding System for Rapid Propagation Measurements"; Bearing a date of Nov. 21, 2012, 7 total pages.

Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; Nov. 6-12, 1999; p. 1-9; PSW/PCIM; Chicago, IL.

Kim, David Y.; "A Design Procedure for Slot Arrays Fed by Single-Ridge Waveguide"; IEEE Transactions on Antennas and Propagation; Nov. 1988; p. 1531-1536; vol. 36, No. 11; IEEE.

Kirschbaum, H.S. et al.; "A Method of Producing Broad-Band Circular Polarization Employing an Anisotropic Dielectric"; IRE Trans. Micro. Theory. Tech.; vol. 5, No. 3; p. 199-203; 1957.

Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; ; IEEE.

Konishi, Yohei; "Channel Sounding Technique Using MIMO Software Radio Architecture"; 12$^{th}$ MCRG Joint Seminar: Bearing a date of Nov. 18, 2010; 28 total pages.

(56) References Cited

OTHER PUBLICATIONS

Kuki, Takao et al., "Microwave Variable Delay Line using a Membrane Impregnated with Liquid Crystal"; Microwave Symposium Digest; ISBN 0-7803-7239-5; Jun. 2-7, 2002; p. 363-366; IEEE MTT-S International.
Leveau et al.; "Anti-Jam Protection by Antenna"; GPS World; Feb. 1, 2013; pp. 1-11; North Coast Media LLC; http://gpsworld.com/anti-jam-protection-by__--antenna/.
Lipworth et al.; "Magnetic Metamaterial Superlens for Increase Range Wireless Power Transfer"; Scientific Reports; Bearing a date of Jan. 101, 2014; pp. 1-6; vol. 4, No. 3642.
Luo et al.; "Hig-directivity antenna with small antenna aperture"; Applied Physics Letters; 2009; pp. 193506-1-193506-3; vol. 95; American Institute of Physics.
Manasson et al.; "Electronically Reconfigurable Aperture (ERA): A New Approach for Beam-Steering Technology"; Bearing dates of Oct. 12-15, 2010; pp. 673-679; IEEE.
McLean et al.; "Interpreting Antenna Performance Parameters for EMC Applications: Part 2: Radiation Patter, Gain, and Directivity"; Created on Apr. 1, 2014; pp. 7-17; TDK RF Solutions Inc.
Mitri, F.G.; "Quasi-Gaussian Electromagnetic Beams"; Physical Review A.; Bearing a date of Mar. 11, 2013; p. 1; vol. 87, No. 035804; (Abstract Only).
Ovi et al.; "Symmetrical Slot Loading in Elliptical Microstrip Patch antennas Partially Filled with Mue Negative Metamaterials"; PIERS Proceedings, Moscow, Russia; Aug. 19-23, 2012; pp. 542-545.
PCT International Search Report; International App. No. PCT/US2014/070650; dated Mar. 27, 2015; pp. 1-3.
PCT International Search Report; International App. No. PCT/US2014/070645; dated Mar. 16, 2015; pp. 1-3.
PCT International Search Report; International App. No. PCT/US2014/017454; dated Aug. 28, 2014; pp. 1-4.
PCT International Search Report; International App. No. PCT/US2011/001755; dated Mar. 22, 2012; pp. 1-5.
Poplavlo, Yuriy et al.; "Tunable Dielectric Microwave Devices with Electromechanical Control"; *Passive Microwave Components and Antennas*; ISBN 978-953-307-083-4; Apr. 2010; p. 367-382; InTech.
Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.
Sakakibara, Kunio; "High-Gain Millimeter-Wave Planar Array Antennas with Traveling-Wave Excitation"; Radar Technology; Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
"Satellite Navigation"; Crosslink; The Aerospace Corporation magazine of advances in aerospace technology; Summer 2002; vol. 3, No. 2; pp. 1-56; The Aerospace Corporation.
Sato, Kazuo et al.; "Electronically Scanned Left-Handed Leaky Wave Antenna for Millimeter-Wave Automotive Applications"; Antenna Technology Small Antennas and Novel Metamaterials; 2006; p. 420-423; IEEE.
Siciliano et al.; "25. Multisensor Data Fusion"; Springer Handbook of Robotics; Bearing a date of 2008, Created on Mar. 18, 2014; 27 total pages; Springer.
Sievenpiper, Dan et al.; "Holographic Artificial Impedance Surfaces for Conformal Antennas"; Antennas and Propagation Society International Symposium; 2005; p. 256-259; vol. 1B; IEEE, Washington D.C.
Sievenpiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.
Smith, David R.; "Recent Progress in Metamaterial and Transformation Optical Design"; NAVAIR Nano/Meta Workshop; Feb. 2-3, 2011; pp. 1-32.
Soper, Taylor; "This startup figured out how to charge devices wirelessly through walls from 40 feet away"; GeekWire; bearing a date of Apr. 22, 2014 and printed on Apr. 24, 2014; pp. 1-12; located at http://www.geekwire.com/2014/ossia-wireless-charging/#disqus_thread.
"Spectrum Analyzer"; Printed on Aug. 12, 2013; pp. 1-2; http://www.gpssource.com/faqs/15; GPS Source.
Sun et al.; "Maximum Signal-to-Noise Ratio GPS Anti-Jam Receiver with Subspace Tracking"; ICASSP; 2005; pp. IV-1085-IV-1088; IEEE.
The State Intellectual Property Office of P.R.C.; Application No. 201180055705.8; May 6, 2015; (received by our Agent on May 11, 2015); pp. 1-11.
Thoma et al.; "MIMO Vector Channel Sounder Measurement for Smart Antenna System Evaluation"; Created on Mar. 18, 2014; pp. 1-12.
Umenei, A.E.; "Understanding Low Frequency Non-Radiative Power Transfer"; Bearing a date of Jun. 2011; 7 total pages; Fulton Innovation LLC.
Utsumi, Yozo et al.; "Increasing the Speed of Microstrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.
Wallace, John; "Flat 'Metasurface' Becomes Aberration-Free Lens"; Bearoing a date of Aug. 28, 2012; 4 total pages; located at: http://www.laserfocusworld.com/articles/2012/08/flat-metasurface-becomes-aberration-free-lens.html.
"Wavenumber"; Microwave Encyclopedia; bearing a date of Jan. 12, 2008; pp. 1-2 P-N Designs, Inc.
Weil, Carsten et al.; "Tunable Inverted-Microstrip Phase Shifter Device Using Nematic Liquid Crystals"; IEEE MTT-S Digest; 2002; p. 367-370; IEEE.
Yan, Dunbao et al.; "A Novel Polarization Convert Surface Based on Artificial Magnetic Conductor"; Asia-Pacific Microwave Conference Proceedings, 2005.
Yee, Hung Y.; "Impedance of a Narrow Longitudinal Shunt Slot in a Slotted Waveguide Array"; IEEE Transactions on Antennas and Propagation; Jul. 1974; p. 589-592; IEEE.
Yoon et al.; "Realizing Efficient Wireless Power Transfer in the Near-Field Region Using Electrically small Antennas"; Wireless Power Transfer; Principles and Engineering Explorations: Bearing a date of Jan. 25, 2012; pp. 151-172.
Young et al.; "Meander-Line Polarizer"; IEEE Trans. Ant. Prop.; p. 376-378; May 1973.
Zhong, S.S. et al.; "Compact ridge waveguide slot antenna array fed by convex waveguide divider"; Electronics Letters; Oct. 13, 2005; p. 1-2; vol. 41, No. 21; IEEE.
Chinese State Intellectual Property Office, Notification of Fourth Office Action, App. No. 2011/80055705.8 (Based on PCT Patent Application No. PCT/US2011/001755); dated May 20, 2016 (received by our agent on May 30, 2016); pp. 1-4 (machine translation only).
Definition from Merriam-Webster Online Dictionary; "Integral"; Merriam-Webster Dictionary; cited and printed by Examiner on Dec. 8, 2015; pp. 1-5; located at: http://www.merriam-webster.com/dictionary/integral.
Varlamos et al.; "Electronic Beam Steering Using Switched Parasitic Smart Antenna Arrays"; Progress in Electromagnetics Research; PIER 36; bearing a date of 2002; pp. 101-119.
PCT International Search Report; International App. No. PCT/US2015/036638; dated Oct. 19, 2015; pp. 1-4.
The State Intellectual Property Office of P.R.C.; Application No. 201180055705.8; Nov. 4, 2015 (received by our Agent on Nov. 10, 2015; pp. 1-11.
PCT International Search Report; International App. No. PCT/US2014/069254; dated Nov. 27, 2015; pp. 1-4.
European Patent Office, Supplementary European Search Report, Pursuant to Rule 62 EPC; App. No. EP 14891152; dated Jul. 20, 2017 (received by our Agent on Jul. 26, 2017); pp. 1-4.
Ayob et al.; "A Survey of Surface Mount Device Placement Machine Optimisation: Machine Classification"; Computer Science Technical Report No. NOTTCS-TR-2005-8; Sep. 2005; pp. 1-34.

(56) References Cited

OTHER PUBLICATIONS

"Aperture", Definition of Aperture by Merriam-Webster; located at http://www.merriam-webster.com/dictionary/aperture; printed by Examiner on Nov. 30, 2016; pp. 1-9; Merriam-Webster, Incorporated.
PCT International Preliminary Report on Patentability; International App. No. PCT/US2014/070645; Jun. 21, 2016; pp. 1-12.
Supplementary European Search Report, Pursuant to Rule 62 EPC; App. No. EP 14 87 2595; dated Jul. 3, 2017 (received by our Agent on Jul. 7, 2017); pp. 1-16.
Supplementary European Search Report, Pursuant to Rule 62 EPC; App. No. EP 14 87 2874; dated Jul. 3, 2017 (received by our Agent on Jul. 7, 2017); pp. 1-15.

* cited by examiner

SLOTTED SURFACE SCATTERING ANTENNAS

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)).

PRIORITY APPLICATIONS

The present application constitutes a continuation-in-part of U.S. patent application Ser. No. 14/506,432, entitled SURFACE SCATTERING ANTENNAS WITH LUMPED ELEMENTS, naming Pai-Yen Chen, Tom Driscoll, Siamak Ebadi, John Desmond Hunt, Nathan Ingle Landy, Melroy Machado, Jay McCandless, Milton Perque, Jr., David R. Smith, and Yaroslav A. Urzhumov as inventors, filed 3 Oct. 2014, which is currently co-pending or is an application of which an application is entitled to the benefit of the filing date, and which is a non-provisional of U.S. Patent Application No. 61/988,023, entitled SCATTERING ANTENNAS WITH LUMPED ELEMENTS, naming Pai-Yen Chen, Tom Driscoll, Siamak Ebadi, John Desmond Hunt, Nathan Ingle Landy, Melroy Machado, Milton Perque, Jr., David R. Smith, and Yaroslav A. Urzhumov as inventors, filed 2 May 2014.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

All subject matter of the above applications is incorporated herein by reference to the extent such subject matter is not inconsistent herewith.

DETAILED DESCRIPTION

Figure 1A:
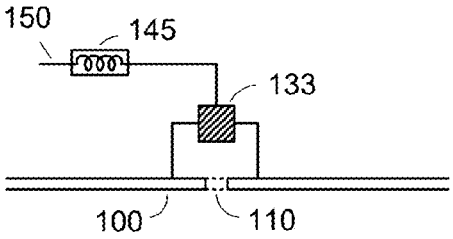
FIGS. 1A-1B depict schematic configurations of scattering elements.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The embodiments relate to surface scattering antennas. Surface scattering antennas are described, for example, in U.S. Patent Application Publication No. 2012/0194399 (hereinafter "Bily I"), with improved surface scattering antennas being further described in U.S. Patent Application Publication No. 2014/0266946 (hereinafter "Bily II"). Surface scattering antennas that include a waveguide coupled to adjustable scattering elements loaded with lumped devices are described in U.S. application Ser. No. 14/506,432 (hereinafter "Chen I"), while various holographic modulation pattern approaches are described in U.S. patent application Ser. No. 14/549,928 ("hereinafter Chen II"). All of these patent applications are herein incorporated by reference in their entirety.

Figure 1B:
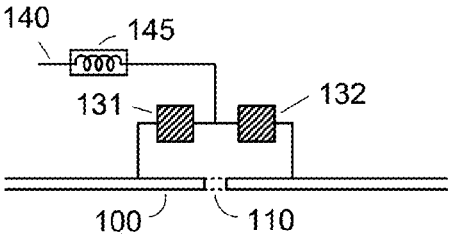

Turning now to a consideration of the scattering elements that are coupled to the waveguide, FIGS. 1A and 1B depict schematic configurations of scattering elements that are defined by a slot or aperture 110 in the ground body 100. For example, the scattering element may be a slot 110 on the upper conductor of a waveguide such as a substrate-integrated waveguide or stripline waveguide. As another example, the scattering element may be a CSRR (complementary split ring resonator) defined by an aperture 110 on the upper conductor of such a waveguide. The scattering element of FIG. 1A is made adjustable by connecting a three-port lumped element 133 across the aperture 110 to control the impedance across the aperture, with a bias control line 150 connected to a third port of the three-port element (with optional bias isolation, as illustrated by the RF choke 145). The scattering element of FIG. 1B is made adjustable by connecting two-port lumped elements 131 and 132 in series across the aperture 110, with a bias control line 140 providing a bias between the two-port lumped elements and the ground body (with optional bias isolation, as illustrated by the RF choke 145). Both lumped elements could be tunable nonlinear lumped elements, such as PIN diodes or varactors, or one could be a passive lumped element, such as a blocking capacitor. The bias control line isolation approaches contemplated in the context of Chen I FIGS. 6A-6D are again contemplated here, as are embodiments that include further lumped elements connected in series or in parallel (for example, a single slot could be spanned by multiple lumped elements placed at multiple positions along the length of the slot).

Figure 2A:
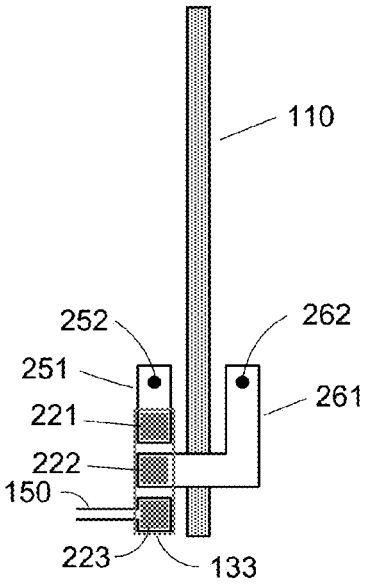
FIGS. 2A-2B depict exemplary physical layouts corresponding to the schematic configurations of FIGS. 1A-1B.
Figure 2B:
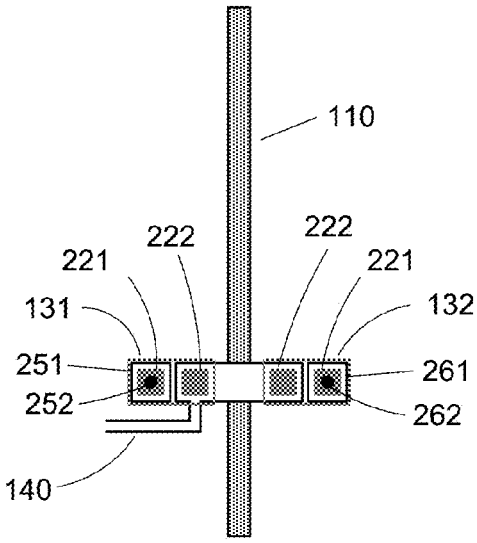

FIGS. 2A and 2B depict exemplary physical layouts corresponding to the schematic lumped element arrangements of FIGS. 1A and 1B, respectively. The figures depict top views of an individual unit cell or scattering element, and the numbered figure elements depicted in FIGS. 1A and 1B are numbered in the same way when they appear in FIGS. 2A and 2B.

With reference to FIG. 2A, the figure depicts an exemplary physical layout corresponding to the schematic three-port lumped element arrangement of FIG. 1A. Vias 252 and 262, situated on either side of the slot 110, connect metal regions 251 and 261 (on an upper metal layer) with the ground body 100 (on a lower metal layer). Then the three-port lumped element 133 is implemented as a surface-mounted component with a first contact 221 that connects the lumped element to the first metal region 251, a second contact 222 that connects the lumped element to the second metal region 261, and a third contact 223 that connects the lumped element to the bias control line 150 (on the upper metal layer).

With reference to FIG. 2B, the figure depicts an exemplary physical layout corresponding to the schematic two-port lumped element arrangement of FIG. 1B. Vias 252 and 262, situated on either side of the slot 110, connect metal regions 251 and 261 (on an upper metal layer) with the ground body 100 (on a lower metal layer). Then the first two-port lumped element 131 is implemented as a surface-mounted component with a first contact 221 that connects the lumped element to the first metal region 251 and a second contact 222 that connects the lumped element to the bias control line 140 (on the upper metal layer); and the second two-port lumped element 132 is implemented as a surface-mounted component with a first contact 221 that connects the lumped element to the second metal region 261 and a second contact 222 that connects the lumped element to the bias control line 140.

Figure 3A:
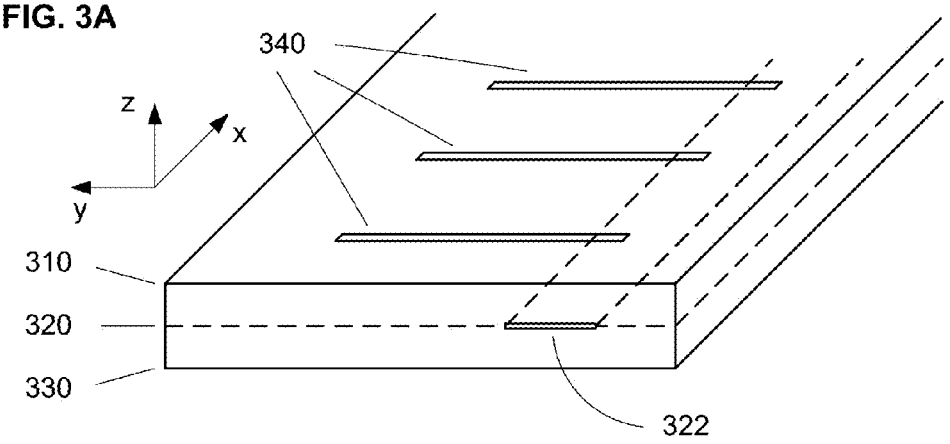
FIGS. 3A-3B depict a first illustrative embodiment of a surface scattering antenna.
Figure 3B:
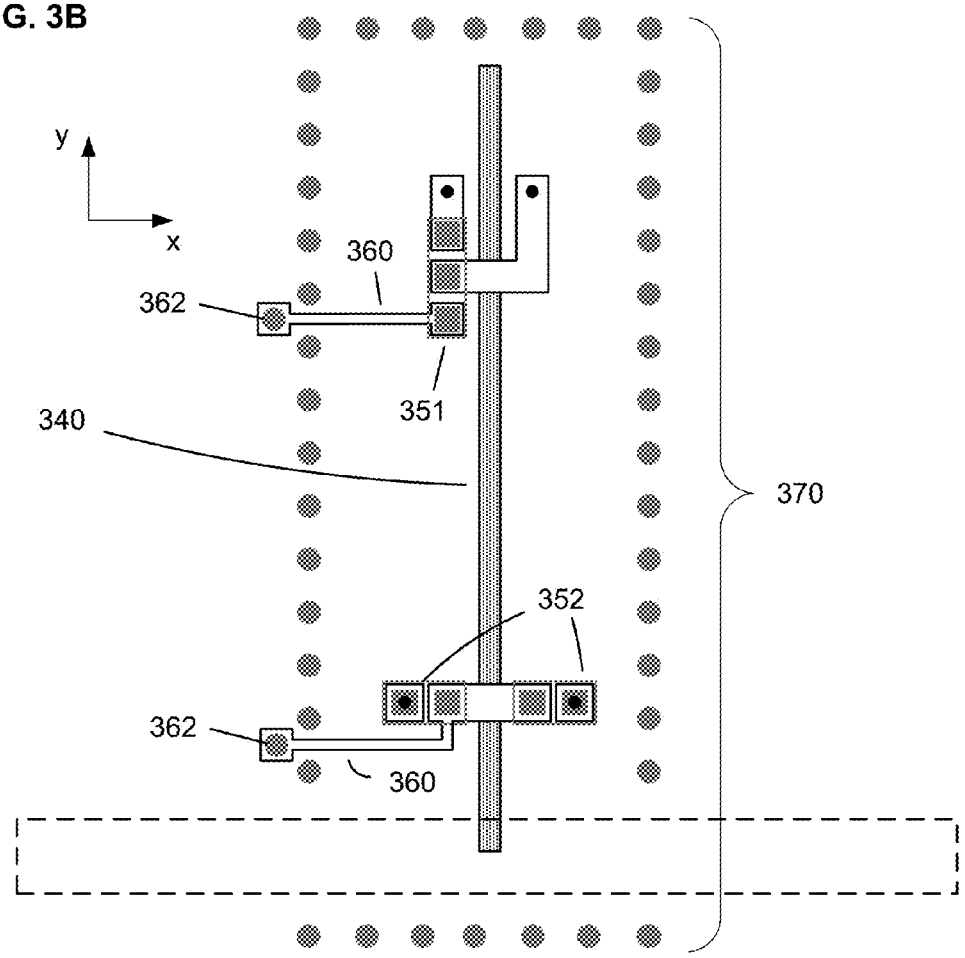

With reference now to FIGS. 3A-3B, a first illustrative embodiment of a surface scattering antenna is depicted. In this embodiment, the waveguide is a stripline structure having an upper conductor 310, a middle conductor layer 320 providing the stripline 322, and a lower conductor layer 330. The scattering elements are a series of slots 340 in the upper conductor, and the impedances of these slots are controlled with lumped elements arranged as in FIGS. 1A, 1B, 2A, and 2B. An exemplary top view of a unit cell is depicted in FIG. 3B. In this example, lumped elements 351 and 352 are arranged to span the upper and lower ends of the slot, respectively, with bias control lines 360 on the top layer of the assembly connected by through vias 362 to bias control circuitry on the bottom layer of the assembly (not shown). In this example, the upper lumped element 351 is a three-port lumped element as in FIG. 2A, while the lower lumped elements 352 are two-port lumped elements as in FIG. 2B. Each unit cell optionally includes a via cage 370 to define a cavity-backed slot structure fed by the stripline as it passes through successive unit cells.

Figure 4:
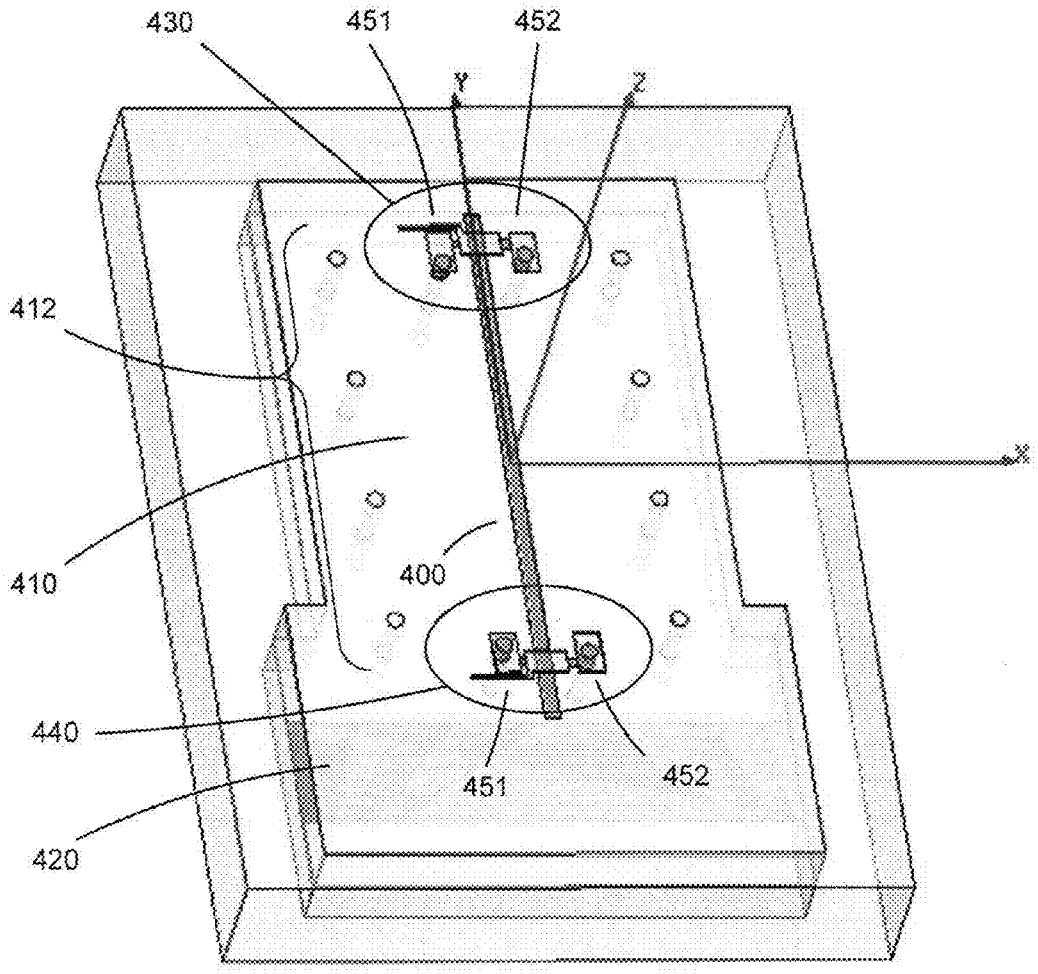
FIG. 4 depicts a second illustrative embodiment of a surface scattering antenna.

With reference now to FIG. 4, a second illustrative embodiment of a surface scattering antenna is depicted. The figure depicts a unit cell of the antenna, including a slot 400 backed by a cavity 410 defined by an optional via cage 412 and fed by the stripline 420 as it proceeds through successive unit cells. The slot includes lumped element loading at an upper station 430 closer to an upper end of the slot 400 and lumped element loading at a lower station 440 closer to a lower end of the slot 400. This illustration is not intended to be limiting; other embodiments provide loading at only a single station along the slot, or loading at more than two stations along the slot. In this example, each station includes a pair of two-port lumped elements 451, 452 connected in series across the slot, but again, this is not intended to be limiting, and some or all stations could use three-port elements.

In some approaches, the pair of two-port lumped elements 451, 452 is a pair of nonlinear variable-impedance devices. For example, the pair of two-port elements can be a pair of varactors (such as solid state or MEMS varactors) or switched capacitors (such as MEMS switched capacitors). In approaches that use a pair of diodes such as varactors diodes, the pair of diodes might be arranged so that each diode has a cathode (anode) connected to the slot and an anode (cathode) connected to the other diode in the pair of diodes. More generally, some approaches use a pair of oppositely-oriented two-port elements, e.g. where each element defines a port A and a port B, with the ports A being connected to the slot and the ports B being commonly connected to a bias line. The oppositely-oriented two-port elements can be identical oppositely-oriented two-port elements.

In some approaches, the pair of two-port elements 451, 452 is a pair of two-port elements configured so that a second harmonic generated by one element is substantially cancelled by a second harmonic generated by the other element. For example, the pair of two-port elements might be a pair of identical, oppositely-oriented elements having equal and opposite second harmonic responses. The cancellation need not be exact; for example, the second harmonic response of one element may cancel about 50%, 75%, 80%, 90%, 95%, 98%, or 99% of the second harmonic response of the other element.

In some approaches that provide multiple stations per unit cell, the loading at an upper station 430 and the loading at a lower station 440 may be selected to provide a broader frequency response of the unit cell. In one approach, the loading at the upper station 430 may be designed to provide a desired loading for a first frequency channel of the antenna, while the loading at the lower station 440 may be designed to provide a desired loading for a second frequency channel of the antenna. In another approach, the broader frequency response is achieved by positioning the first and second stations to reduce or minimize a frequency variation of the unit cell's frequency response (e.g. as characterized by a scattering parameter for the unit cell). Alternatively or additionally, the broader frequency response is achieved by selecting the loadings at the first and second stations (e.g. selecting the lumped elements at the first and selecting stations, or selecting their configurations and/or biases) to reduce or minimize a frequency variation of the unit cell's frequency response.

Figure 5:
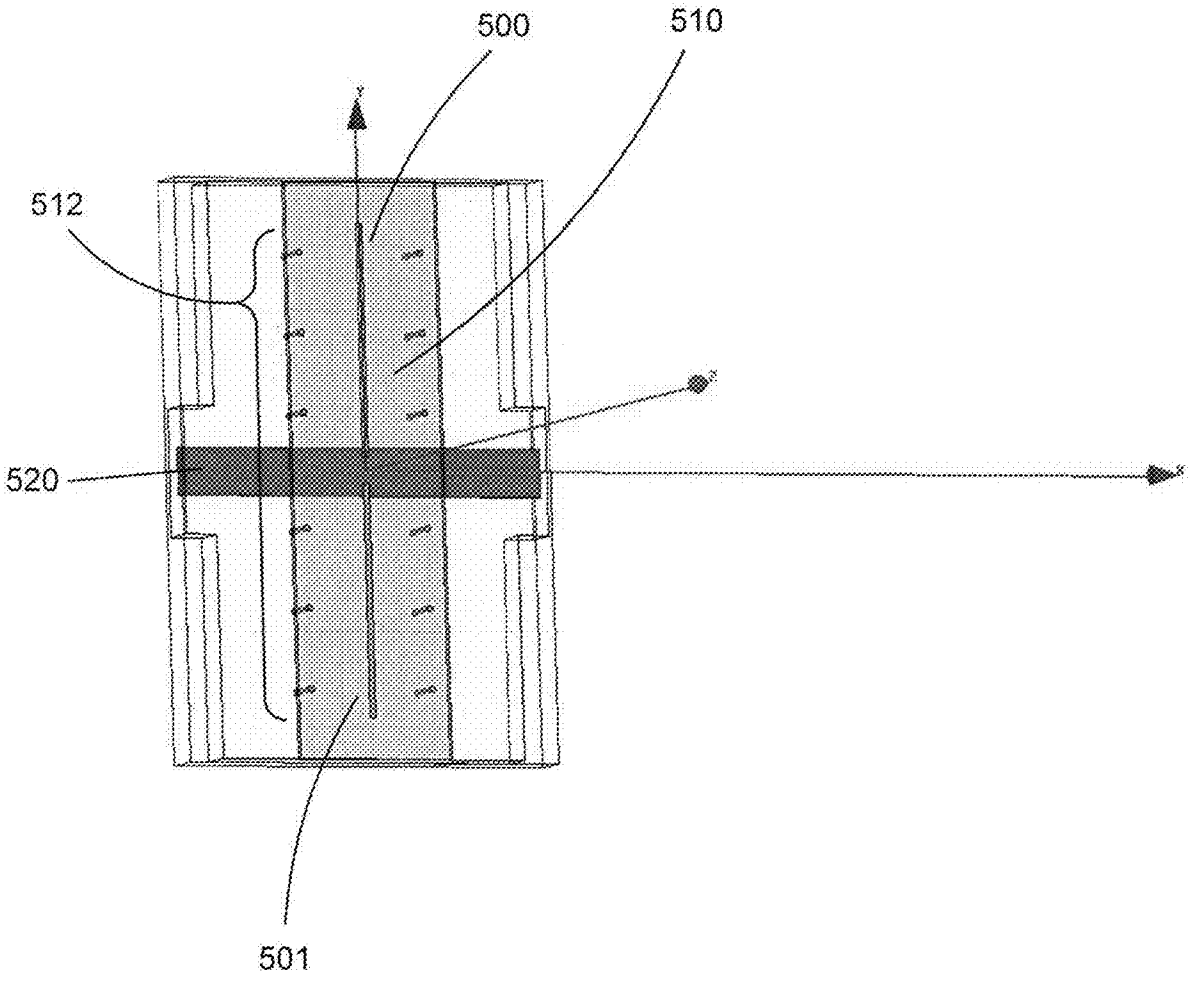
FIG. 5 depicts a third illustrative embodiment of a surface scattering antenna.

With reference now to FIG. 5, a third illustrative embodiment of a surface scattering antenna is depicted. The figure depicts a unit cell of the antenna, including a first slot 500 coupled to a left edge of the stripline 520 and a second slot 501 coupled to a right edge of the stripline 520. The slots are optionally enclosed in a cavity 510 defined by a via cage 512. While the example depicts the first and second slots at an equal position along the length of the stripline, in other approaches the first and second slots are at staggered positions along the length of the stripline; for example, the second slots may be positioned at midpoints between the positions of the first slots of adjacent unit cells.

Figure 6A:
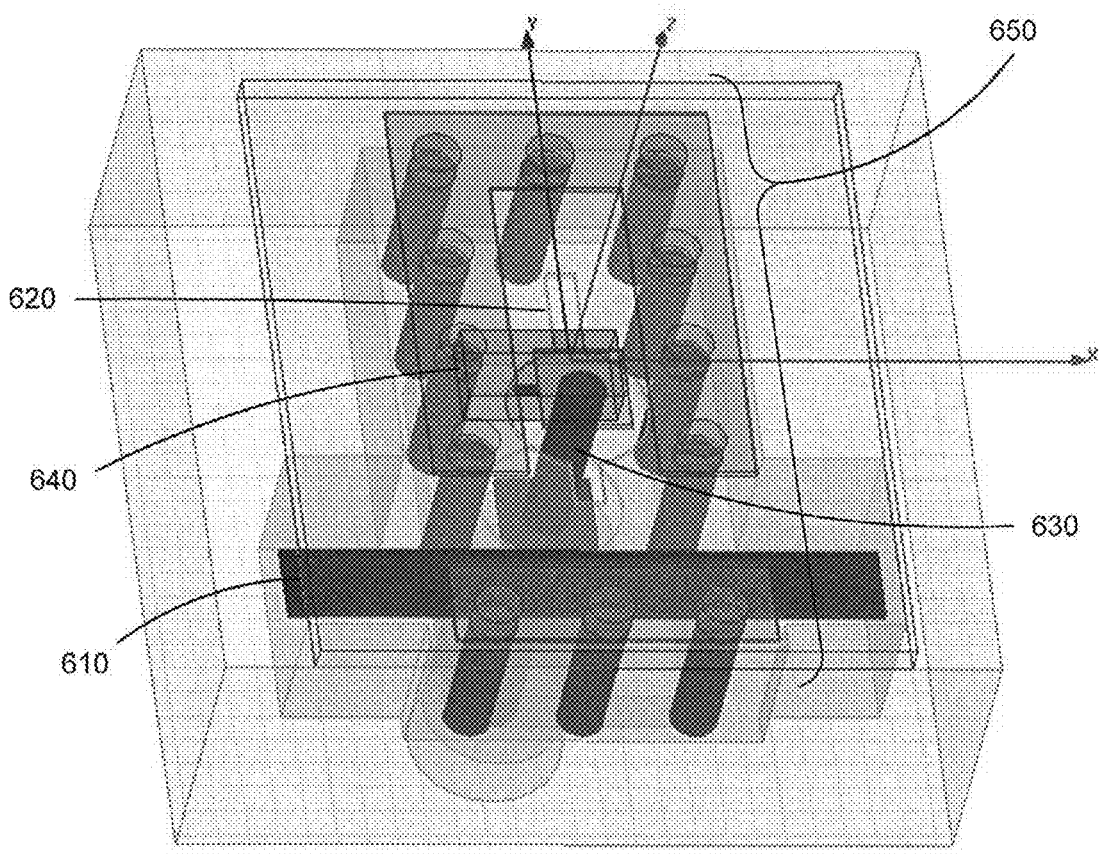
FIGS. 6A-6B depict a fourth illustrative embodiment of a surface scattering antenna.
Figure 6B:
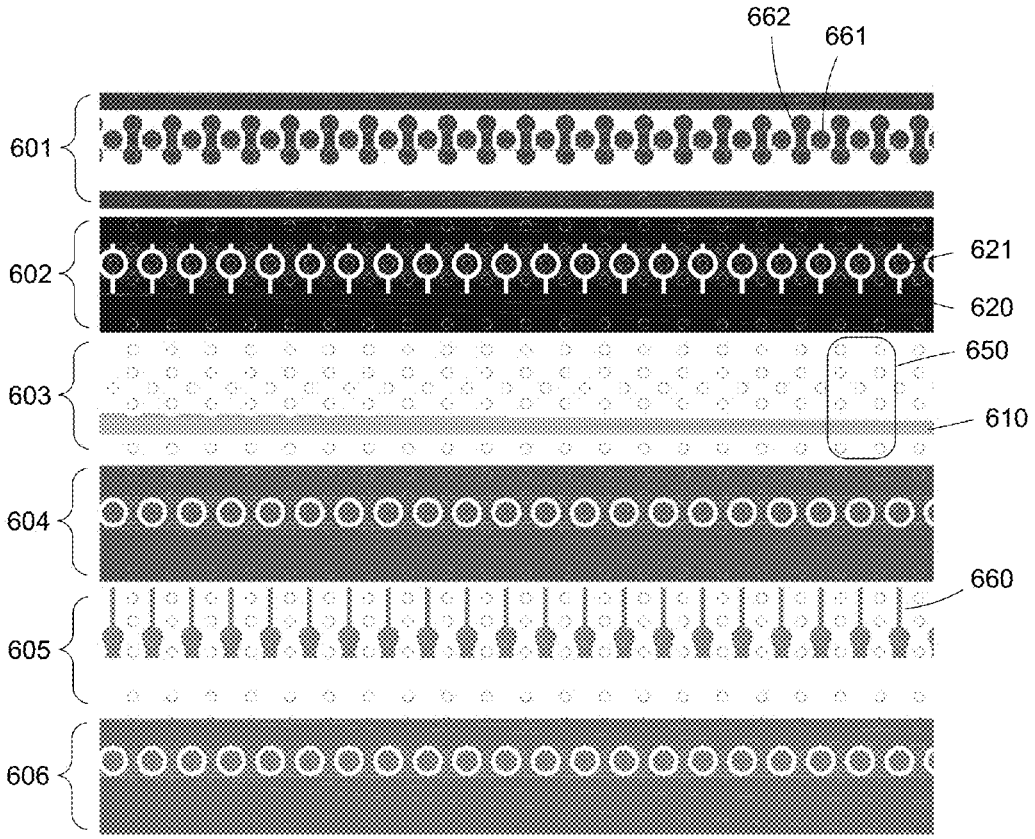

With reference now to FIGS. 6A and 6B, a fourth illustrative embodiment of a surface scattering antenna is depicted. FIG. 6A depicts a unit cell of the embodiment, while FIG. 6B depicts the metal layers 601-606 of a multi-layer PCB process implementing the embodiment (the intervening dielectric layers are not shown). In this embodiment, the stripline 610 is implemented on layer 603 with an upper ground plane 602 and a lower ground plane 604. The unit cell scattering element is implemented as a slot 620 in the upper ground plane 602 having a "keyhole" shape whereby to admit a bias line 630 for the lumped element 640 that provides the adjustability for the scattering element. Thus, the "keyhole" opening includes an antipad enclosing a pad 621 for the bias line. In one approach, the lumped element 640 is connected directly to the metal layer 602 to extend between the continuous ground plane and the bias pad 621; in another approach, the antenna includes an optional top metal layer 601 and the lumped element 640 is connected between an upper bias pad 661 and a metal region 662 (the metal portions 661 and 662 being connected by vias to the bias pad 621 and upper ground plane 602, respectively). The keyhole slot 620 is backed by a cavity defined by the upper ground plane 602, the lower ground plane 604, and a via cage 650 that extends at least from metal layer 602 to metal layer 604 (the vias may extend further as appropriate to simplify the PCB manufacturing process). A lower metal layer 605 includes RF stub chokes 660 for the bias lines, which continue to extend to a bottom layer 606 for control circuitry. Thus, the bias lines 630 extend from the topmost metal layer 601 or 602 to the bottommost metal layer 606, with the RF stub chokes and antipads providing electrical isolation through the metal layers shown in FIG. 6B.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An antenna, comprising:

a waveguide;

a plurality of subwavelength radiative elements coupled to the waveguide; and a plurality of lumped element circuits directly coupled to the subwavelength radiative elements and configured to adjust radiation characteristics of the subwavelength radiative elements;

wherein the waveguide includes a bounding surface, and the plurality of subwavelength radiative elements includes a plurality of unit cells each containing a slot in the bounding surface;

wherein the waveguide defines a propagation direction, and the subwavelength radiative elements have inter-element spacings along the propagation direction that are substantially less than a free-space wavelength corresponding to an operating frequency band of the antenna; and wherein the inter-element spacings are less than or equal to one-third of the free-space wavelength.

2. The antenna of claim 1, wherein the waveguide is a stripline waveguide.

3. The antenna of claim 2, wherein the plurality of subwavelength radiative elements includes:

a first plurality of subwavelength radiative elements coupled to a left edge of the stripline waveguide; and a second plurality of subwavelength radiative elements coupled to a right edge of the stripline waveguide.

4. The antenna of claim 3, wherein the first plurality and the second plurality are positioned at equal positions along a length of the stripline waveguide.

5. The antenna of claim 3, wherein the first plurality and the second plurality are positioned at first and second staggered positions along a length of the stripline waveguide.

6. The antenna of claim 5, wherein the second staggered positions are midpoints between adjacent first positions.

7. The antenna of claim 1, wherein the inter-elements spacings are less than or equal to one-fourth of the free-space wavelength.

8. The antenna of claim 1, wherein the inter-elements spacings are less than or equal to one-fifth of the free-space wavelength.

9. The antenna of claim 1, wherein each slot defines a slot width dimension and a slot length dimension, and the slot length dimension is substantially equal to one-half of the free-space wavelength.

10. The antenna of claim 9, wherein the slot length dimension corresponds to a direction perpendicular to the propagation direction.

11. The antenna of claim 1, wherein the lumped circuit elements include, for each of the plurality of unit cells, a three-port element with a first port connected to one side of the slot and a second port connected to another slide of the slot.

12. The antenna of claim 11, further comprising, for each of the plurality of unit cells: a bias voltage line connected to a third port of the three-port element.

13. The antenna of claim 11, wherein each three-port element is a transistor.

14. The antenna of claim 1, wherein the lumped circuit elements include, for each of the plurality of unit cells, a pair of two-port elements connected in series across the slot.

15. The antenna of claim 14, wherein the pair of two-port elements is a diode and a blocking capacitor.

16. The antenna of claim 14, further comprising, for each of the plurality of unit cells: a bias voltage line connected between a node common to the pair of two-port elements.

17. The antenna of claim 14, wherein each pair of two-port elements is a pair of nonlinear variable-impedance devices.

18. The antenna of claim 17, wherein each pair of nonlinear variable-impedance devices is a matched pair of nonlinear variable-impedance devices.

19. The antenna of claim 17, wherein the nonlinear variable-impedance devices include MEMS switched capacitors or MEMS varactors.

20. The antenna of claim 14, wherein the pair of two-port elements is a pair of diodes.

21. The antenna of claim 20, wherein each diode in the pair of diodes has a cathode connected to the slot and an anode connected to the other diode in the pair of diodes.

22. The antenna of claim 20, wherein each diode in the pair of diodes has an anode connected to the slot and a cathode connected to the other diode in the pair of diodes.

23. The antenna of claim 20, wherein the pair of diodes is a pair of varactors.

24. The antenna of claim 14, wherein the pair of two-port elements is a pair of oppositely-oriented two-port elements.

25. The antenna of claim 24, wherein the pair of oppositely-oriented two-port elements is a pair of identical, oppositely-oriented two-port elements.

26. The antenna of claim 14, wherein the pair of two-port elements is configured so that a first 2nd harmonic generated by a first element in the pair of two-port elements is substantially cancelled by a second 2nd harmonic generated by a second element in the pair of two-port elements.

27. The antenna of claim 1, wherein the lumped circuit elements include, for each of the plurality of unit cells, a first lumped element connected at or near an upper end of the slot and a second lumped element connected at or near a lower end of the slot.

28. The antenna of claim 27, wherein the lumped circuit elements further include one or more additional lumped elements connected at one or more additional positions along the slot between the first lumped element and the second lumped element.

29. The antenna of claim 27, wherein:

the radiation characteristics of the subwavelength radiative elements include, for each unit cell, a scattering parameter having a frequency variation at an operating frequency band of the antenna; and positions of the first and second lumped elements are selected to reduce or minimize the frequency variation of the scattering parameter.

30. The antenna of claim 27, wherein:

the radiation characteristics of the subwavelength radiative elements include, for each unit cell, a scattering parameter having a frequency variation at an operating frequency band of the antenna; and the first and second lumped elements have respective first and second impedances that vary with frequency, the first and second variable impedances being selected to reduce or minimize the frequency variation of the scattering parameter.

31. The antenna of claim 27, wherein:

the radiation characteristics of the subwavelength radiative elements include, for each unit cell, a total scattering parameter that includes contributions from a first scattering parameter corresponding to the first lumped element and a second scattering parameter corresponding to the second lumped element;

wherein a frequency variation of the first scattering parameter is substantially complementary to a frequency variation of the second scattering parameter.

32. The antenna of claim 27, wherein the first lumped element is a first varactor and the second lumped element is a second varactor.

33. The antenna of claim 27, wherein the first lumped element is a first transistor and the second lumped element is a second transistor.

34. The antenna of claim 27, wherein the first lumped element is a varactor and the second lumped element is a transistor.

35. The antenna of claim 1, wherein the waveguide is a stripline waveguide, the bounding surface is an upper ground plane of the stripline, and each slot includes an opening sufficient to admit a bias line for the lumped element circuit of that unit cell.

36. The antenna of claim 35, wherein each slot includes narrow first portion that extends from the opening and towards the stripline and a narrow second portion that extends from the opening and away from the stripline.

37. The antenna of claim 36, wherein the opening is a circular antipad enclosing a pad for the bias line.

38. The antenna of claim 35, wherein each slot has a total length equal to about one-half of a free-space wavelength corresponding to an operating frequency band of the antenna, where the total length equals a length of the narrow first portion plus a length of the narrow second portion plus a diameter of the opening.

39. The antenna of claim 35, wherein the stripline waveguide includes a lower ground plane and each bias line extends through both the upper ground plane and the lower ground plane.

40. The antenna of claim 39, further comprising:

for each unit cell, a stub choke for the bias line.

41. The antenna of claim 40, wherein each stub choke is configured to provide a high impedance of the bias line at an operating frequency band of the antenna.

42. The antenna of claim 40, wherein each stub choke is positioned on a metal layer positioned below the lower ground plane of the stripline waveguide.

43. The antenna of claim 39, wherein each unit cell includes an arrangement of vias enclosing both the stripline and the slot.

44. The antenna of claim 43, wherein the upper ground plane, the lower ground plane, and the arrangement of vias define a cavity volume for the unit cell.

45. The antenna of claim 35, further comprising:

a dielectric layer positioned above the upper ground plane, where each bias line extends through the dielectric layer to connect to the lumped element circuit on the upper surface of the dielectric layer.

* * * * *